US006724691B1

(12) United States Patent
Kaminsky

(10) Patent No.: US 6,724,691 B1
(45) Date of Patent: Apr. 20, 2004

(54) OPEN-FACED WATCH DISPLAY

(76) Inventor: Edward Kaminsky, 900 Palmer Ave. Suite 9F, Bronxville, NY (US) 10708

( * ) Notice: Subject to any disclaimer, the term of this patent is extended or adjusted under 35 U.S.C. 154(b) by 0 days.

(21) Appl. No.: 09/504,522

(22) Filed: Feb. 15, 2000

Related U.S. Application Data

(63) Continuation-in-part of application No. 09/195,277, filed on Nov. 18, 1998.

(51) Int. Cl.[7] ..... G04B 19/00

(52) U.S. Cl. ..... 368/76; 368/80; 368/223; 368/228

(58) Field of Search ..... 368/76, 80, 77, 368/223, 228, 232–234

(56) References Cited

U.S. PATENT DOCUMENTS

| | | | | |
|---|---|---|---|---|
| 1,475,800 A | * | 11/1923 | Creasy | 368/233 |
| 2,536,237 A | | 1/1951 | Clock | |
| 2,958,181 A | | 11/1960 | Laughlin | |
| 3,763,648 A | * | 10/1973 | Pakter et al. | |
| 4,726,000 A | | 2/1988 | Weiss | |
| 4,945,523 A | | 7/1990 | Lam | 368/285 |
| 5,224,078 A | | 6/1993 | Mallin | 368/223 |
| 5,586,089 A | * | 12/1996 | McGarvey | 368/223 |
| 5,850,373 A | * | 12/1998 | Lee | 368/65 |

* cited by examiner

*Primary Examiner*—Vit Miska
(74) *Attorney, Agent, or Firm*—Gibbons, Del Deo, Dolan, Griffinger & Vecchione

(57) ABSTRACT

The apparatus of timepieces which provide an unobstructed central area of a permanent opaque face for enhanced display of artwork, logos, holograms, text, designs and/or pictures which enables the wearer to discern the time.

17 Claims, 3 Drawing Sheets

OPEN-FACED WATCH DISPLAY

CROSS-REFERENCE TO RELATED APPLICATION

This application is a continuation-in-part application and claims priority of Ser. No. 09/195,277 filed on Nov. 18, 1998 and entitled "Open-Faced Watch Display".

FIELD OF THE INVENTION

This invention redesigns traditional watches, clocks and the like, in order to provide an unhindered view of the face of the timepiece. The unobstructed area, subsequently created by concealing the center post and a portion of the hands, provides a platform that will more prominently exhibit material for personal, artistic and business purposes. Some specific applications that would benefit in having an unimpaired display are pictures, artwork, promotion and advertising, and three-dimensional images.

BACKGROUND OF THE INVENTION

Watches, clocks and like apparatus for indicating time are well known. A typical device 100 is illustrated in FIGS. 1*a* and 1*b*. Commonly, device 100 comprises transparent crystal 110 that is attached to, and seals with, bezel 161 of opaque body 160. Seen through crystal 110 is opaque face 140, center post 125, hands 120 and 130, and time demarcation marks 170. On the reverse side of opaque face 140, and therefore unseen, is drive mechanism 150 which directly links, through the center of opaque face 140, to center post 125 thereby actuating hands 120 and 130 to circumscribe opaque face 140. The position of hands 120 and 130 in relation to marks 170 conveys the time of day.

The limitation with such devices as described above is that center post 125, and hands 120 and 130, are above opaque face 140, which results in hindering the display in the central part of the opaque face. For example, it would be preferable to have a watch, bearing a design on its opaque face, which did not have the central part of the image disrupted by physical parts of the device. Such unimpeded watch displays are particularly advantageous for promotional uses where a logo or advertisement can be imprinted on a watch face. Alternative applications are: forms of artistic expression, pictures, three dimensional sculptures or figures, interior coordinating design work, team and league affiliations, personal unique designs and/or text, etc. What is common to all these applications is the advantage of having an unobstructed face. Thus, there exists a need for a watch wherein the center post and hands of the watch do not interfere with the central display the watch opaque face.

Indeed, Mallin in U.S. Pat. No. 5,224,078, recognized the need to personalize watches but his patent imposes undesirable constraints and characteristics on his watch displays and watch designs. In all cases, he discloses a watch that exhibits conventional hands extending from a center post. Integral to his design is a removable disc, either translucent or opaque with a cutout for display of a miniaturized version of a conventional watch face. Said disc rests on the shoulder of the watch casing and is not adhered to the housing or affixed to the watch. This necessitates a means to secure the disc in place and a twist-off crystal on top of the disc, consequently adding excess bulk to the device.

The instant invention fills the need to have an unobstructed, permanent opaque face on a watch while still being able to determine the time in a traditional manner through viewing the tip of the hands in relation to the perimeter of the watch; the medial aspects of the hands wrap around unobserved, since they are overlapped by the opaque face. An additional aspect of the invention is the sealing of the opaque face to the housing and/or affixed to the center post, which is under the opaque face of the device.

The additional benefit of having a prominent display of permanent advertising or personalized face without obscuring the time displayed on the watch is therefore achieved by this invention. The result provides a timepiece that is more thin, durable and easier to manufacturer while still providing the goal of an unobstructed view of the central portion of the face. Therefore, the instant invention fulfills the longed for need of a streamlined watch wherein a permanent opaque face, capable of prominently displaying unique images/artwork, is an integral part of the watch and the wearer is still able to discern the time.

SUMMARY OF THE INVENTION

The present invention restructures watches, clocks and other indicating devices to provide an unobstructed central area of the device while maintaining the overall traditional perception of the device. Some specific applications that would benefit in having an unencumbered display are time indicating devices used for advertising. These devices may bear pictures, photographs, logos, artwork, three-dimensional images, holograms, or other types of advertising indicia. Similarly, time indicating devices of the present invention may be used for purposes other than advertising, such as keepsakes, souvenirs, and gifts. When used for these purposes the opaque face may be used to display photographs, pictures, artwork, three-dimensional artwork, or other non-advertising indicia.

According to the invention, it is an object of the present invention to provide an open-faced watch display.

It is a further object of the present invention to provide an open-faced watch display including a permanent opaque face, having a slightly smaller diameter than the bezel, sealed to the housing of the watch and resting on the center post above the bezel thereby forming a gap. The center post of the device extends from the drive mechanism to the underside of the opaque face. The hands are connected to the center post. The drive mechanism causes the hands to rotate in a traditional circular manner except under the opaque face and only the end of the hands are seen. Since the hands are positioned under the opaque face and the center post is blocked by the opaque face, there is no obstruction to the central viewing area of the opaque face.

With these and other objects in view, in one embodiment of the invention the hands extend from the center post on the underside of the opaque face, outward beyond the periphery of the opaque face thereby being exposed to view. The bezel, which may have demarcations of time or other design features on its outer aspects, extends inward and parallel in a lower plane relative to the opaque face so as to further support the center post. The body of the timepiece is notched to accept the crystal and seal the device. The time of day can be determined by the position of the exposed end of the hands which overlay the bezel without the opaque face being obscured The opaque face may have advertising or non-advertising indicia upon it.

In another embodiment of the invention the hands, which are below the opaque face, are above a projection from the body of the watch. The projection extends inward and parallel with the face, to conjoin and support the center post. The outer portion of the projection may have demarcations of time or other decorative designs and would be exposed since the opaque face is smaller than the projection. The hands would be sized larger than the opaque face but smaller than the extent of the projection. The opaque face may have either advertising or non-advertising indicia on it.

In another embodiment of the invention the opaque face extends to the body of the watch. The outer aspect of the opaque face is of transparent material thereby exposing the end of the hands to view. The opaque face is supported centrally by the center post and peripherally by the watch body where it is sealed.

In another embodiment of the invention a time-indicating apparatus is provided having an opaque face that provides an indication of time without obscuring the opaque face of the apparatus. The apparatus has a housing and a drive mechanism mounted in the housing under an opaque face. One or more time indicators are connected to and driven by the drive mechanism with the time indicators extending beyond a periphery of the opaque face to indicate the time of day.

In another embodiment of the invention a time-indicating apparatus is provided having an opaque face that provides an indication of time without obscuring the opaque face of the apparatus with the time indicators being at least two hands.

In another embodiment of the invention a time-indicating apparatus is provided having an opaque face that provides an indication of time without obscuring the opaque face of the apparatus with the opaque face containing advertising indicia.

In another embodiment of the invention a time-indicating apparatus is provided having an opaque face that provides an indication of time without obscuring the opaque face of the apparatus with the opaque face contains non-advertising indicia.

In another embodiment of the invention a time-indicating apparatus is provided having an opaque face that provides an indication of time without obscuring the opaque face of the apparatus with a bezel that is substantially concentric to and parallel with the opaque face. The bezel is located in a plane below the opaque face to form a gap therebetween. The time indicators are shaped to extend outwardly, beyond the periphery of the opaque face through the gap between the bezel and the opaque face so as to provide an indication of time relative to the bezel without obscuring the opaque face.

In another embodiment of the invention a time-indicating apparatus is provided having an opaque face that provides an indication of time without obscuring the opaque face of the apparatus with a housing containing a drive mechanism, one or more time indicators driven by the drive mechanism, an opaque face having an opaque center portion to a transparent portion on the periphery, and where the time indicators are connected to the drive mechanism on the underside of the opaque face.

In another embodiment of the invention a time-indicating apparatus is provided having an opaque face that provides an indication of time without obscuring the opaque face of the apparatus with a housing containing a drive mechanism, a center post connected to the drive mechanism, one or more time indicators driven by the drive mechanism, an opaque face having an opaque center portion to a transparent portion on the periphery, and where the time indicators are connected to the center post, which is on the underside of the opaque face.

In another embodiment of the invention a time-indicating apparatus is provided having an opaque face that provides an indication of time without obscuring the opaque face of the apparatus where a projection that is substantially concentric to and parallel with the opaque face is shown. The projection extends from the side wall of the apparatus inward toward the center of the opaque face and is located in a plane below the opaque face to form a gap therebetween. The time indicators are shaped to extend outwardly, toward the transparent periphery of the opaque face, and crossing into said periphery through the gap between the projection and the opaque face so as to provide an indication of time relative to the projection without obscuring the face.

These and other aspects and features of the present invention will become better understood with reference to the following drawings and written descriptions.

DETAILED DESCRIPTION OF THE PREFERRED EMBODIMENTS

Figure 1A:
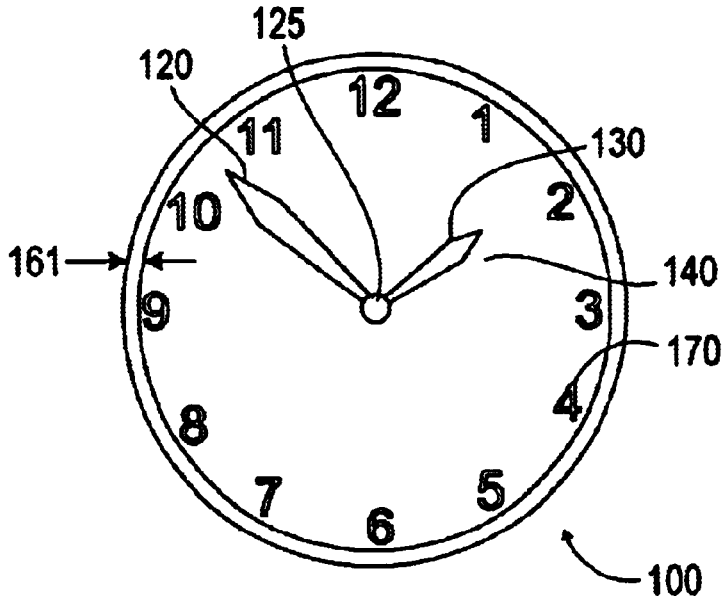
FIG. 1a PRIOR ART
FIG. 1*a* is an illustration of the front view of a conventional watch.
Figure 1B:
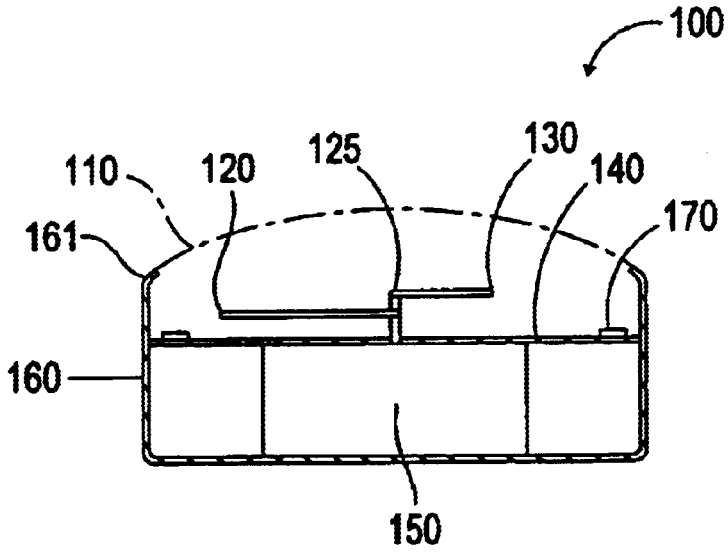
FIG. 1b PRIOR ART
FIG. 1*b* is an illustration of a cross-sectional view of a conventional watch corresponding to FIG. 1*a*.
Figure 2A:
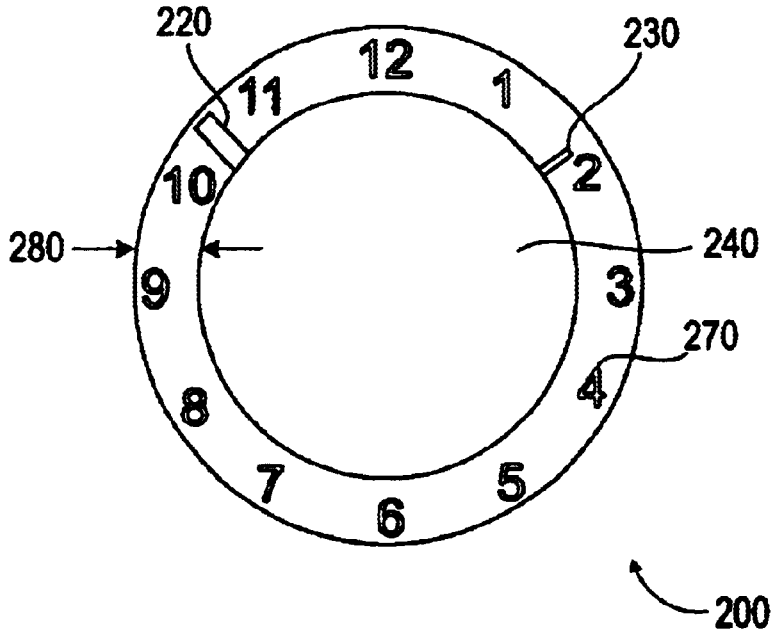
FIG. 2*a* is an illustration of the front view of an embodiment of the present invention.
Figure 2B:
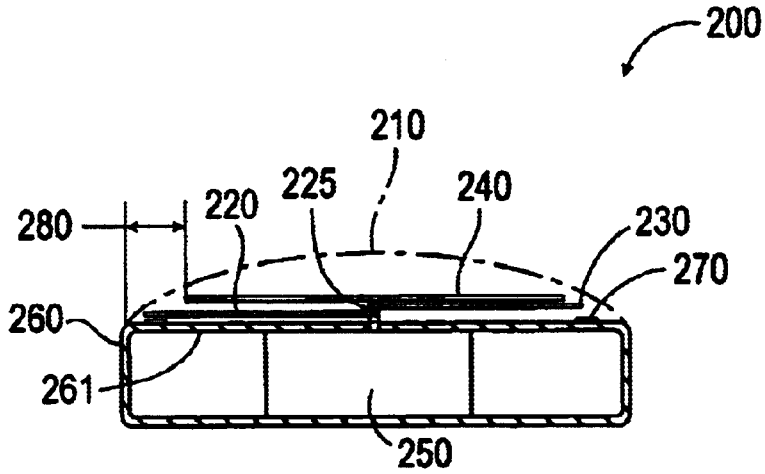
FIG. 2*b* is an illustration of a cross-sectional view of an embodiment of the present invention corresponding to FIG. 2*a*.

An illustration of the first preferred embodiment of the present invention is shown in FIGS. 2*a* and 2*b* as device 200. Device 200 contains a single-housed, single transparent crystal 210 that seals with opaque body 260 at its outermost edge. Bezel 261 is shaped to extend horizontally inward to converge and support center post 225. Contained within body 260 is drive mechanism 250. The outer aspects of bezel 261 have time demarcations 270 inscribed on its surface. Seen through crystal 210 is opaque face 240. The opaque face 240 is of a smaller diameter then bezel 261, so that the outer portion of bezel 261 is in view. On the reverse side of and !supporting opaque face 240 is center post 225, which links to drive mechanism 250. Below opaque face 240 are hands 220 and 230 which extend from center post 225 outward and parallel to opaque face 240, beyond the outer, aspects of opaque face 240 so as to be seen through crystal 210. The section in which the end of hands 220 and 230 are exposed to view is identified as area 280. In this arrangement, therefore, only opaque face 240 and area 280 are in view from crystal 210. Most notably, center post 225 and the central portion of hands 220 and 230 are obscured from view.

The end of hands 220 and 230, visible on bezel 261, indicate time by their position in relation to marks 270. Thus, a user of device 200 can determine the time indicated by the device without the opaque image/design that appears on opaque face 240 being marred by center post 225 and hands 220 and 230. A modification would be to eliminate the time demarcations on bezel 261; the user thusly, would estimate the time of day by the position of the end of the hands. Another modification would be to incorporate patterns, design work, etc., on bezel 261.

Opaque face 240 may be made of plastic, metal, wood, or a combination of materials. Opaque face 240 could show advertising, such as television show titles with or without corresponding images of the stars of said television shows, movie titles, again with or without images of the stars of said movies, major corporations, merchandise such as Coke®, Nike®, etc. Other variations may include non-advertising media such as images of photographs of individuals and/or written messages. These variations are not to be limiting and may include a host of other images and words.

Figure 3A:
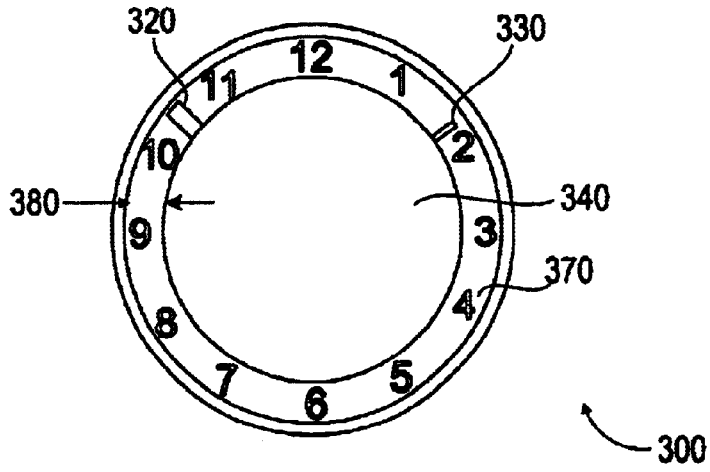
FIG. 3*a* is an illustration of the front view of an alternate embodiment of the present invention.
Figure 3B:
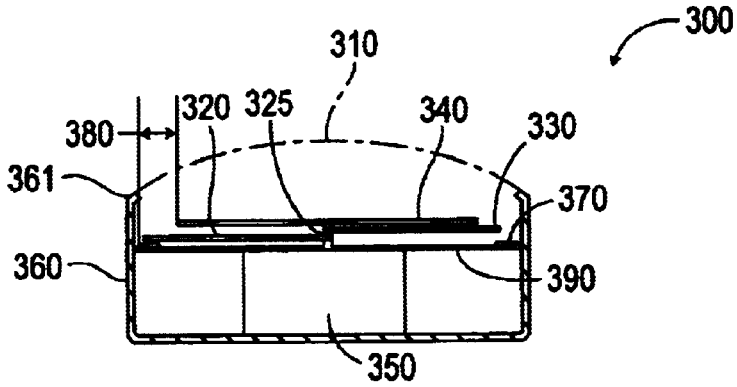
FIG. 3*b* is an illustration of a cross-sectional view of the embodiment of the present invention corresponding to FIG. 3*a*.
Figure 3C:
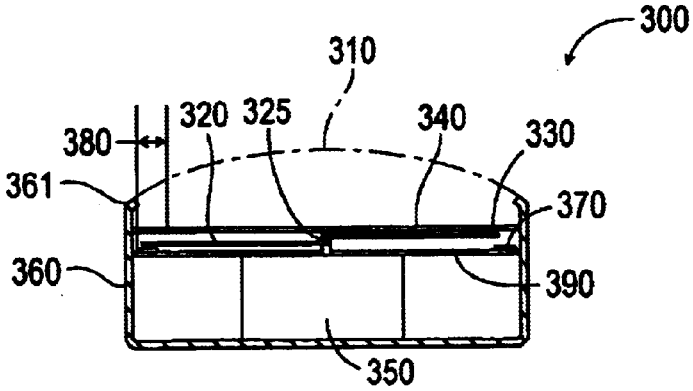
FIG. 3*c* is an illustration of a cross-sectional view of a variation of the embodiment of the present invention corresponding to FIG. 3*a*.

An illustration of the second preferred embodiment of the present invention is shown in FIGS. 3*a*, 3*b* and 3*c* as device 300. Device 300 contains a single-housed, single transparent crystal 310 that seals with opaque body 360 at bezel 361. Contained within body 360 is drive mechanism 350. Projection 390, which can be an extension of body 360 or an independent member fixed to body 360, extends inward to conjoin and support center post 325. Inscribed on the periphery of projection 390 are marks 370. Seen through crystal 310 is opaque face 340. On the reverse side of and supporting opaque face 340 is center post 325, which links to drive mechanism 350. As seen in FIG. 3*b*, hands 320 and 330 extend from center post 325 outward and parallel to opaque face 340, beyond the outer aspects of opaque face 340 so as to be seen through crystal 310. The section in which the end of hands 320 and 330 are exposed to view is identified as area 380. In this arrangement, therefore, only opaque face 340 and area 380 are in view from crystal 310. Thusly, center post 325 and the central portion of hands 320 and 330 are obscured from view.

Opaque face 340 may be made of plastic, metal, wood, or a combination of materials. Opaque face 340 could show advertising, such as television show titles with or without corresponding images of the stars of said television shows, movie titles, again with or without images of the stars of said movies, major corporations, merchandise such as Coke®, Nike®, etc. Other variations may include non-advertising media such as images of photographs of individuals and/or written messages. These variations are not to be limiting and may include a host of other images and words.

A variation in the second embodiment is shown in FIG. 3*c* whereby opaque face 340 extends to and seals with body 360. The periphery of opaque face 340 is of transparent material which permits viewing marks 370 as well as the tip of hands 320 and 330, to the extent delineated by area 380, through crystal 310. The central portion of opaque face 340, medial to the transparent material, is opaque for an unhindered presentation of an image/design.

The end of hands 320 and 330, visible on projection 390, indicate time by their position in relation to marks 370. Thus, a user of device 300 can determine the time indicated by the device without the opaque image/design, that appears on opaque face 340, from being marred by center post 325 and hands 320 and 330. A modification would be to eliminate the time demarcations on projection 390; the user thusly, would estimate the time of day by the position of the end of the hands. Another modification would be to incorporate patterns, design work, etc., on projection 390. Still another modification would be to eliminate the support of opaque face 340 by center post 325, since opaque face 340 adjoins and seals with body 360, and would result in a thinner device.

The present invention, therefore, is well adapted to carry out the objects and attain the ends and advantages mentioned herein as well as other ends and advantages that are made apparent from the disclosure. While preferred embodiments of the invention have been described for the purpose of disclosure, numerous changes and modification to those embodiments described herein will be readily apparent to those skilled in the art and are encompassed within the spirit of the invention and the scope of the following claims.

What is claimed is:

1. A time-indicating apparatus that provides an indication of time, said apparatus comprising:

a crystal;

a housing supporting the crystal, the crystal being sealed to the housing;

a face arranged spatially between the crystal and the housing, an entirety of the face being spaced from and out of contact with the crystal, the face having an opaque portion arranged to obstruct a view of a region beneath the opaque portion when viewing through the crystal, the opaque portion and the crystal being separate from each other to define a spacing that is between the opaque portion and the crystal;

one or more time indicators arranged between the housing and the crystal to indicate time of day, the one or more time indicators being outside of the region obstructed by the opaque portion so as to be visible through the crystal; and a bezel spaced from the face to define a gap between the bezel and the face, the bezel having a surface that is substantially concentric to and parallel with said opaque portion of said face, the surface having a center portion within the region obstructed by the opaque portion and having a peripheral portion outside of the region obstructed by the opaque portion.

2. The apparatus of claim 1 wherein said time indicators comprise at least two hands.

3. The apparatus of claim 1 wherein said opaque portion of said face contains advertising indicia.

4. The apparatus of claim 1 wherein said opaque portion of said face contains non-advertising indicia.

5. The apparatus of claim 1, wherein said time indicators are shaped to extend outwardly beyond said periphery of said opaque portion of said face through the gap between said bezel and said opaque face so as to provide an indication of time relative to said bezel without obscuring said opaque face.

6. The apparatus of claim 5 wherein said time indicators comprise at least two hands.

7. The apparatus of claim 5 wherein said opaque portion of said face contains advertising indicia.

8. The apparatus of claim 5 wherein said opaque portion of said face contains non-advertising indicia.

9. The apparatus of claim 1, further comprising a transparent element neighboring said opaque portion, said time indicators being arranged to be visible through said transparent element when viewed through said crystal.

10. The apparatus of claim 9, further comprising a projection that is substantially concentric to and parallel with said face, said projection extending from one of the housing and the crystal in a direction inward and located in a plane below said face as viewed through the crystal, the projection and the face being spaced from each other to define a gap, wherein said time indicators are shaped to extend outwardly through the gap so as to provide an indication of time relative to said projection without obscuring said face.

11. The apparatus of claim 1, further comprising:

a drive mechanism between said face and said housing, the one or more time indicators being arranged to be driven by said drive mechanism.

12. The apparatus of claim 11, further comprising a post supporting said face and extending between said face and said drive mechanism, said time indicators extending outwardly from said post.

13. An apparatus as in claim 1, wherein the bezel has time demarcations so that the one of more time indicators indicate the time of day by their position in relation to the time demarcations.

14. A time-indicating apparatus that provides an indication of time, said apparatus comprising:

a crystal;

a housing supporting the crystal, the crystal being seated to the housing;

a face arranged spatially between the crystal and the housing, the face having an opaque portion arranged to obstruct a view of a region beneath the opaque portion when viewing through the crystal, the opaque portion and the crystal being separate from each other to define a spacing that is between the opaque portion and the crystal, an entirety of the face being spaced from and out of contact with the crystal;

one or more indicators arranged between the housing and the crystal to indicate time of day, the one or more time indicators being outside of the region obstructed by the opaque portion so as to be visible through the crystal;

a post supporting said face; and a bezel spaced from said face to define a gap between the face and the bezel, the bezel being substantially concentric to and parallel with said opaque portion of said face, the bezel having a center potion within the region obstructed by the opaque portion and having a peripheral portion outside of the region obstructed by the opaque portion.

15. An apparatus as in claim 14, further comprising a drive mechanism between the face and the housing, the one or more time indicators being arranged to be driven by the drive mechanism.

16. An apparatus as in claim 15, wherein the post extends between the face and the drive mechanism, the time indicators extending outwardly from the post.

17. An apparatus as in claim 14, wherein the bezel has time demarcations so that the one of more time indicators indicate the time of day by their position in relation to the time demarcations.

* * * * *